US011465314B2

(12) United States Patent
Shibata

(10) Patent No.: US 11,465,314 B2
(45) Date of Patent: Oct. 11, 2022

(54) METHOD OF PRODUCING INSULATOR FOR SPARK PLUG

(71) Applicant: DENSO CORPORATION, Kariya (JP)

(72) Inventor: Masamichi Shibata, Kariya (JP)

(73) Assignee: DENSO CORPORATION, Kariya (JP)

( * ) Notice: Subject to any disclaimer, the term of this patent is extended or adjusted under 35 U.S.C. 154(b) by 255 days.

(21) Appl. No.: 16/985,469

(22) Filed: Aug. 5, 2020

(65) Prior Publication Data

US 2021/0039277 A1 Feb. 11, 2021

(30) Foreign Application Priority Data

Aug. 6, 2019 (JP) ..... JP2019-144876

(51) Int. Cl.

| | |
|---|---|
| ***B28B 1/44*** | (2006.01) |
| ***B28B 7/06*** | (2006.01) |
| ***B28B 13/06*** | (2006.01) |
| ***H01T 13/20*** | (2006.01) |
| ***B28B 7/28*** | (2006.01) |
| ***B28B 7/34*** | (2006.01) |
| ***B28B 11/08*** | (2006.01) |
| ***B28B 7/10*** | (2006.01) |

(52) U.S. Cl.

CPC ..... *B28B 1/44* (2013.01); *B28B 7/06* (2013.01); *B28B 7/10* (2013.01); *B28B 7/285* (2013.01); *B28B 7/348* (2013.01); *B28B 11/0818* (2013.01); *B28B 13/06* (2013.01); *H01T 13/20* (2013.01)

(58) Field of Classification Search

CPC .... B28B 1/44; B28B 7/06; B28B 7/10; B28B 7/285; B28B 7/348; B28B 11/0818; B28B 13/06; B28B 3/003; B28B 11/0863; B28B 1/30; H01T 13/20; H01T 21/02; H01T 13/38; C04B 2235/6028

See application file for complete search history.

(56) References Cited

U.S. PATENT DOCUMENTS

2011/0005485 A1 1/2011 Kurono et al.
2012/0055018 A1* 3/2012 Honda ..... H01T 13/38 29/887

FOREIGN PATENT DOCUMENTS

JP 2000-058226 2/2000

* cited by examiner

*Primary Examiner* — Jacob T Minskey
*Assistant Examiner* — S. Behrooz Ghorishi
(74) *Attorney, Agent, or Firm* — Nixon & Vanderhye P.C.

(57) ABSTRACT

A method of producing a cylindrical insulator for a spark plug includes a molding step of forming ceramic powder filled in a cavity defined by a mold and a molding pin into a compact. In a first removal step of removing the compact from the mold, the compact has at least one protrusion formed in at least one recess of the molding pin formed in an outer cylindrical surface of the molding pin, and the at least one protrusion is locked in the at least one recess, thereby allowing the compact to be removed with the molding pin from the mold. In a second removal step of removing the molding pin from the compact, the molding pin is turned or rotated in the circumferential direction about the compact, causing the at least one recess to cut the at least one protrusion from the compact, and thereafter the molding pin is removed from the compact.

5 Claims, 14 Drawing Sheets

METHOD OF PRODUCING INSULATOR FOR SPARK PLUG

CROSS-REFERENCE TO RELATED APPLICATION

This application is based on and claims the benefit of priority from earlier Japanese Patent Application No. 2019-144876 filed Aug. 6, 2019, the description of which is incorporated herein by reference.

BACKGROUND

Technical Field

The present disclosure relates to a method of producing an insulator for a spark plug.

Related Art

A spark plug is connected to an ignition coil for an internal combustion engine and receives sparking high voltage applied from the ignition coil to generate a spark between the center electrode and the ground electrode. A spark plug includes a housing having the ground electrode, a central shaft having the center electrode, and a cylindrical insulator that insulates the housing and the central shaft from each other.

In a known method of producing an insulator for a spark plug, raw material powder filled in a mold with a press pin placed therein is compressed and formed into a compact, the compact with the press pin placed therein is removed from the mold, and the press pin is removed from the compact.

The press pin used in the known method described above includes a head placed outside the compact and a shaft placed inside the compact. The shaft has a pin screw formed on its proximal end part as a helical rib. After the compact is formed in the cavity defined by the mold and the press pin, the compact with the press pin placed therein is extracted from the mold by raising a holder holding the head of the press pin. In this step, the pin screw embedded in the compact allows the compact caught on the press pin to be extracted. Outside the mold, when the press pin is extracted from the compact, the press pin is turned about the longitudinal direction of the compact. The turn extracts the press pin from the compact.

DESCRIPTION OF SPECIFIC EMBODIMENTS

Figure 1:
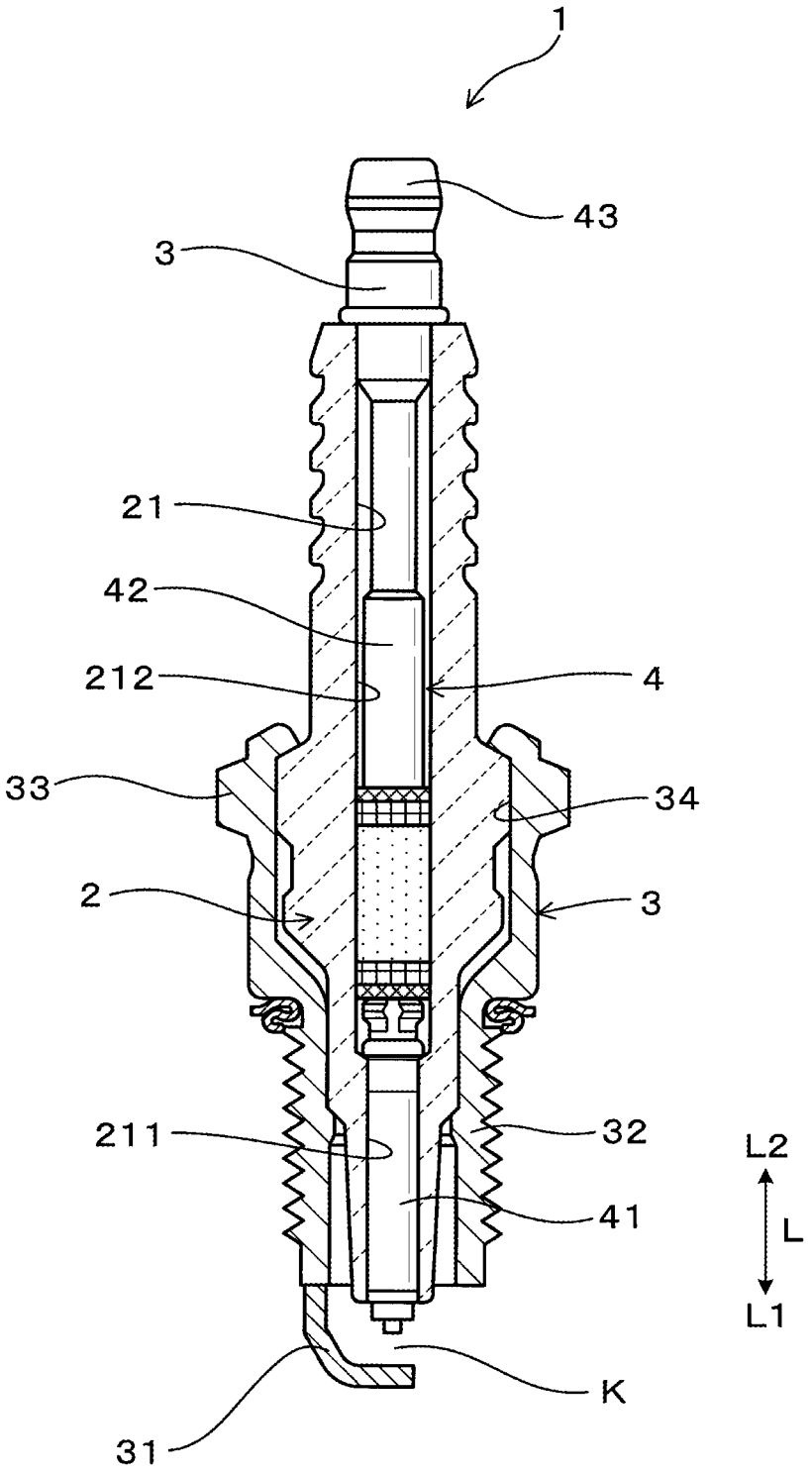
FIG. 1 is a cross-sectional view of a spark plug according to an embodiment.

The above known method of producing an insulator for a spark plug is disclosed in JP-A-2000-58226. In this method, the pin screw of the press pin needs to be formed from the proximal end part of the shaft toward the distal end for the structural reason that the press pin is turned and extracted from the compact. Thus, when the compact is extracted from the mold, the distal end part of the compact may not be sufficiently caught on the press pin, and the compact may suffer damage such as chips or cracks in its distal end part.

In view of the above, it is desired to have a method of producing an insulator for a spark plug with reduced damage such as chips or cracks.

One aspect of the present disclosure provides a method of producing a cylindrical insulator for insulating, in a spark plug, a housing having a ground electrode and a central shaft having a center electrode from each other. The method includes: a molding step of forming into a compact ceramic powder filled in a cavity defined by a mold configured to form an outer face of the insulator and a molding pin placed in the mold and configured to form an inner face of the insulator; a first removal step of removing, from the mold, the compact with the molding pin placed therein; and a second removal step of removing the molding pin from the compact.

The molding pin has at least one recess formed in an outer cylindrical surface of the molding pin partially along a circumferential direction of the outer cylindrical surface.

In the first removal step, the compact has at least one protrusion formed in the at least one recess of the molding pin, and the at least one protrusion is locked in the at least one recess, thereby allowing the compact to be removed with the molding pin from the mold.

In the second removal step, the molding pin is turned or rotated in the circumferential direction about the compact, causing the at least one recess to cut the at least one protrusion from the compact, and thereafter the molding pin is removed from the compact.

In the method of producing an insulator for a spark plug according to the aspect, the molding pin has a shape formed in a manner to prevent damage such as chips or cracks from occurring in the compact when the molding pin and the compact are removed from the mold and when the molding pin is removed from the compact.

In the molding step, when the ceramic powder is formed into the compact in the cavity, the ceramic powder filled in the at least one recess of the molding pin is formed as the at least one protrusion. Then, fitting between the at least one recess and the at least one protrusion integrates the molding pin and the compact with each other.

Then, in the first removal step, the compact is removed from the mold with the molding pin. In this step, the at least one protrusion of the compact formed in the at least one recess of the molding pin is locked in the at least one recess, thus allowing the compact to be removed with the molding pin. The at least one recess in the molding pin may be provided in the outer cylindrical surface of the molding pin partially along the circumferential direction. The at least one recess may be provided not only in the proximal end portion of the molding pin shaft, which faces a shallow part of the mold, but also in a distal end part of the molding pin, which faces a deep part of the mold, or in an intermediate part between the distal end part and the proximal end part.

In this manner, the at least one recess may be provided at any position in the outer cylindrical surface of the molding pin. The at least one recess thus allows the compact to be readily caught on the molding pin when the compact is removed from the mold. As a result, the compact is removed from the mold with the molding pin, with less damage such as chips or cracks.

Then, in the second removal step, the molding pin is removed from the compact. In this step, the molding pin is turned or rotated in the circumferential direction about the compact, causing the at least one recess of the molding pin to cut the at least one protrusion of the compact. The surface of the compact from which the at least one protrusion has been cut is evened off by the outer cylindrical surface of the molding pin.

In the second removal step, since the molding pin is turned or rotated in the circumferential direction to cut the at least one protrusion of the compact, the molding pin is removed from the compact with less damage such as chips or cracks.

The method of producing an insulator for a spark plug according to the aspect allows an insulator to be formed with reduced damage such as chips or cracks.

Embodiments of the present disclosure now will be described more fully hereinafter with reference to the accompanying drawings, in which embodiments of the disclosure are shown.

Embodiments

Figure 2:
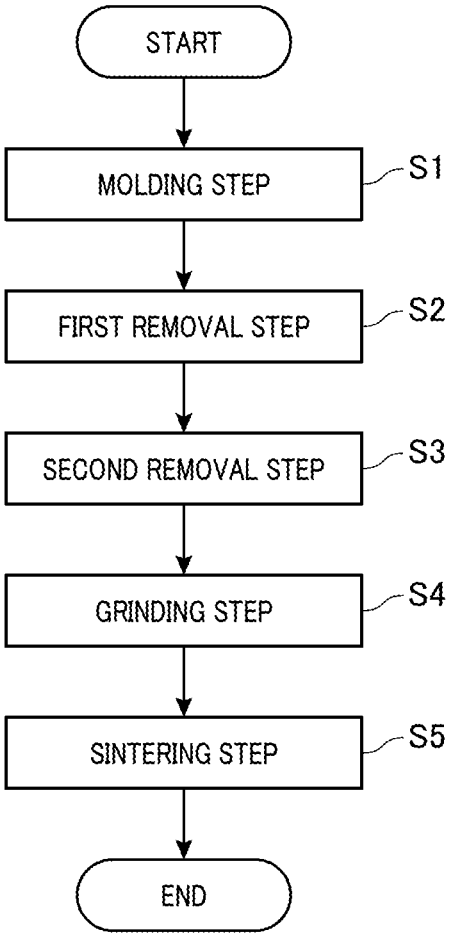
FIG. 2 is a flowchart of a method of producing an insulator for a spark plug according to the embodiment.

A method of producing an insulator 2 for a spark plug 1 in the present embodiment is used to produce a cylindrical insulator 2 that insulates a housing 3 having a ground electrode 31 and a central shaft 4 having a center electrode 41 from each other in the spark plug 1, as illustrated in FIG. 1. In the method of producing the insulator 2, as illustrated in FIG. 2, molding step S1, first removal step S2, and second removal step S3, followed by grinding step S4 and sintering step S5 described later are performed to produce the insulator 2.

Figure 3:
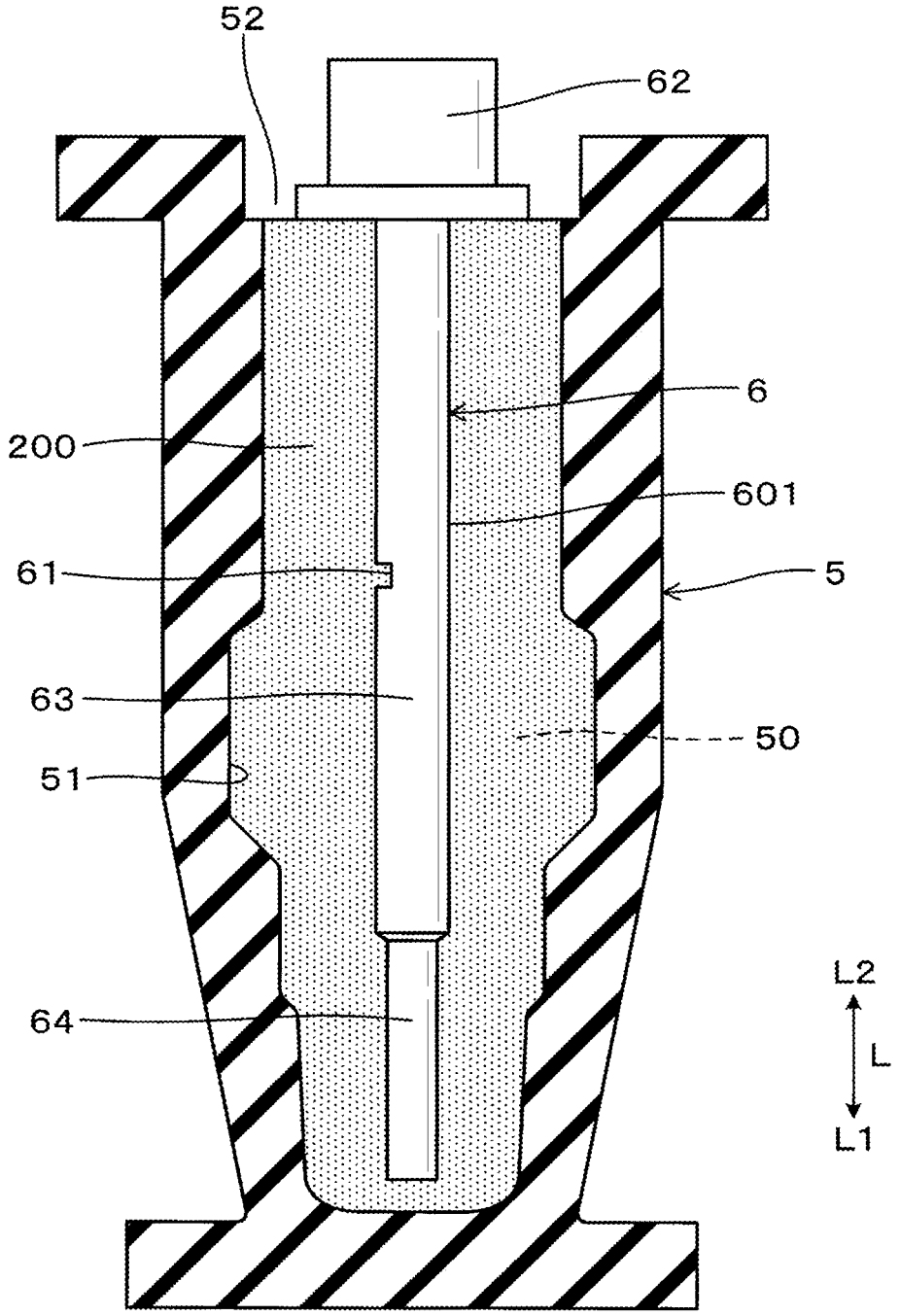
FIG. 3 is a cross-sectional view of a mold and a molding pin forming a cavity filled with ceramic powder in a molding step according to the embodiment.
Figure 4:
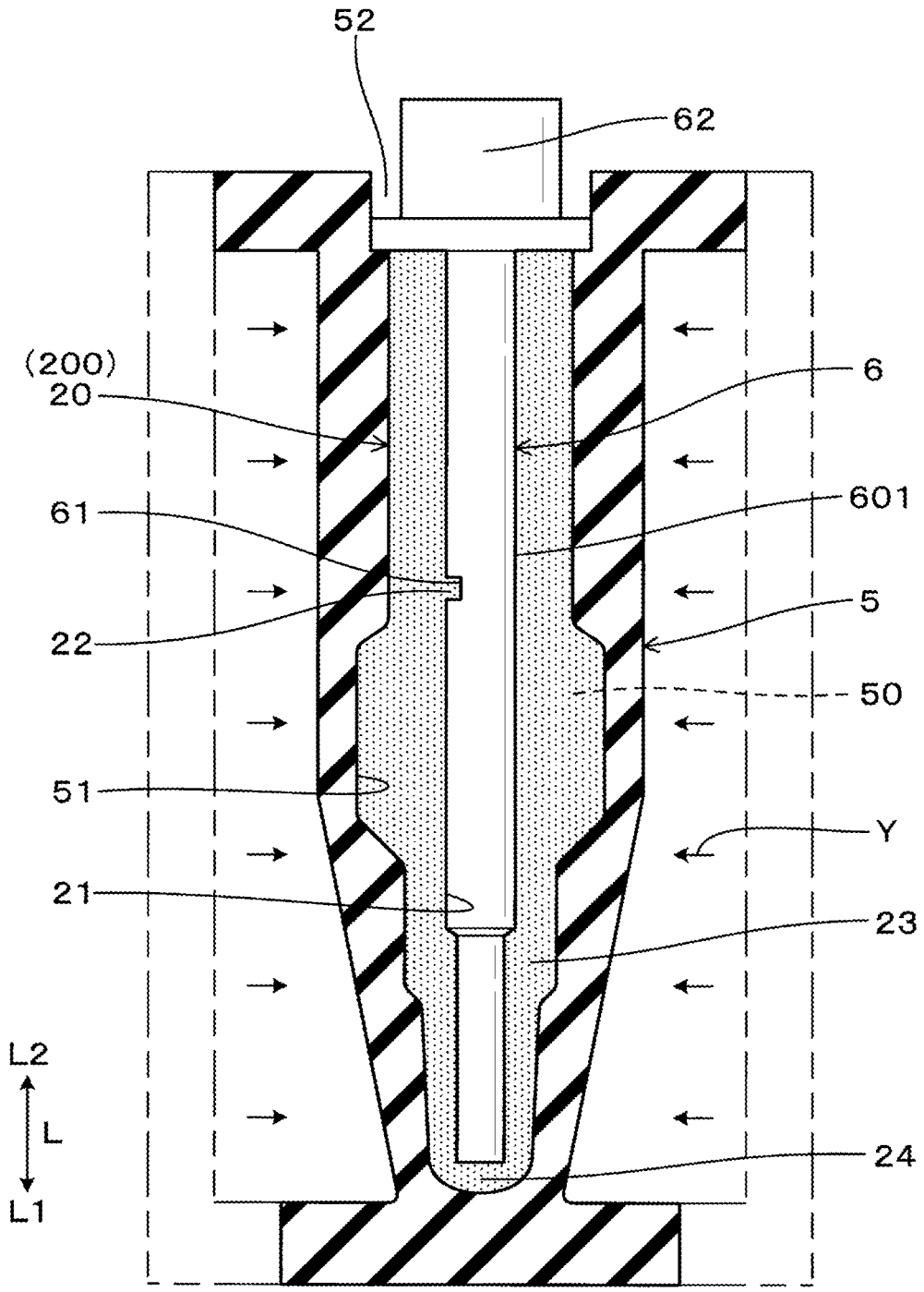
FIG. 4 is a cross-sectional view of a compact formed in the cavity in the molding step according to the embodiment.
Figure 5:
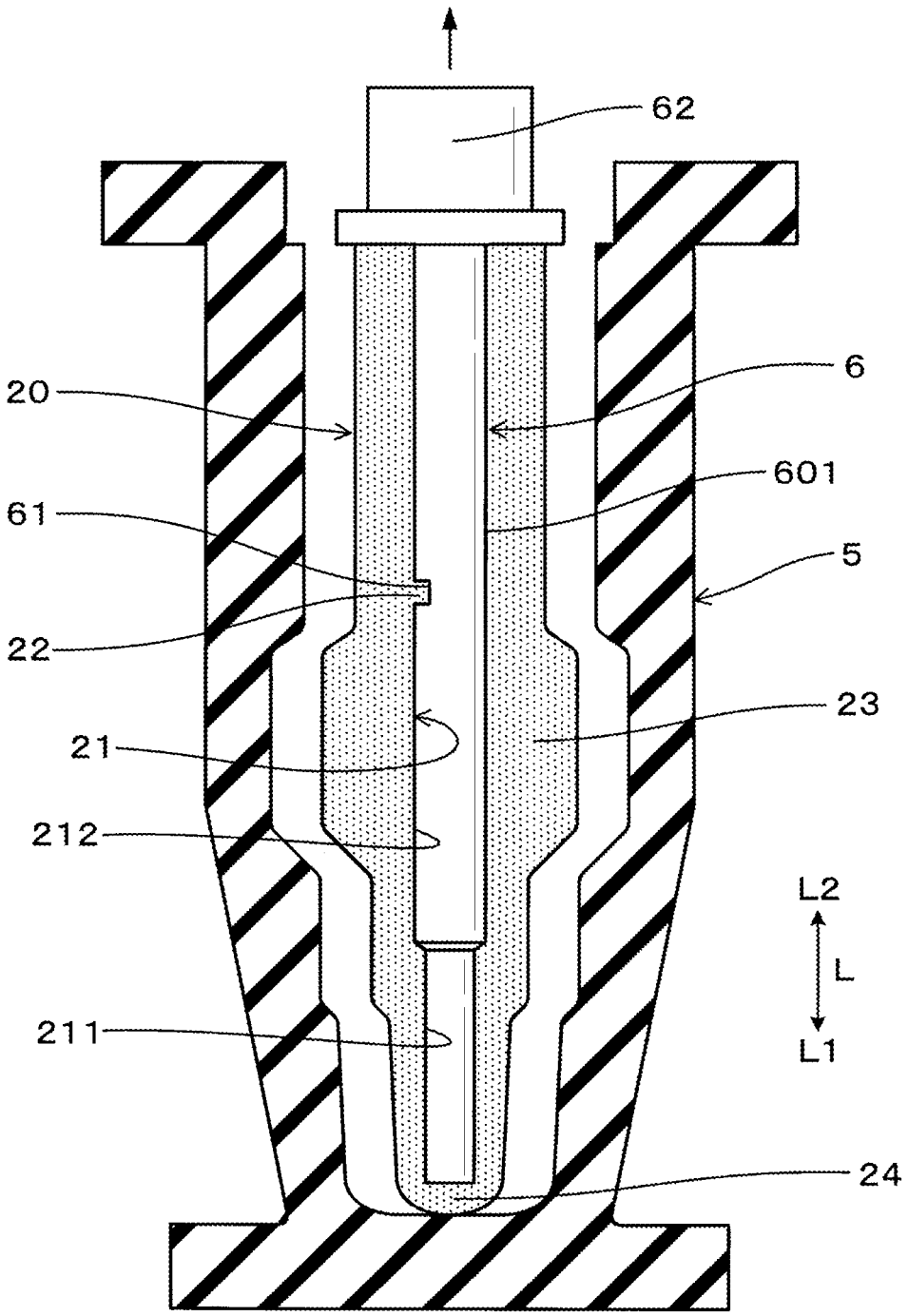
FIG. 5 is a cross-sectional view of the compact to be removed from the mold with the molding pin in a first removal step according to the embodiment.
Figure 6:
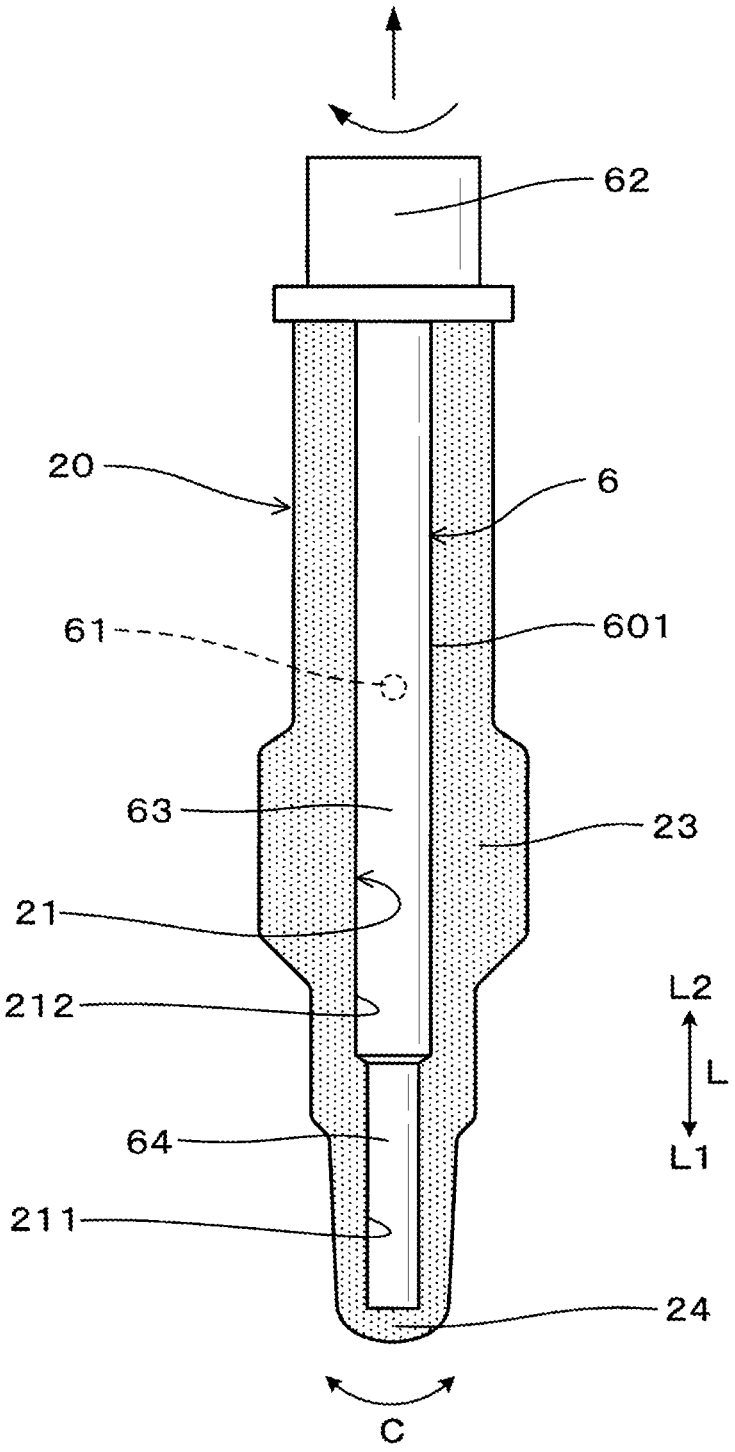
FIG. 6 is a cross-sectional view of the molding pin that has been turned in the circumferential direction and is to be removed from the compact in a second removal step according to the embodiment.

In molding step S1, as illustrated in FIGS. 3 and 4, a cavity 50 is formed by a mold 5 that forms the outer face of the insulator 2 and a molding pin 6 that is placed in the mold 5 and forms the inner face of the insulator 2, and ceramic powder 200 filled in the cavity 50 is formed into a compact 20. In first removal step S2, as illustrated in FIG. 5, the compact 20 with the molding pin 6 placed therein is removed from the mold 5. In second removal step S3, as illustrated in FIGS. 6 to 8, the molding pin 6 is removed from the compact 20.

Figure 7:
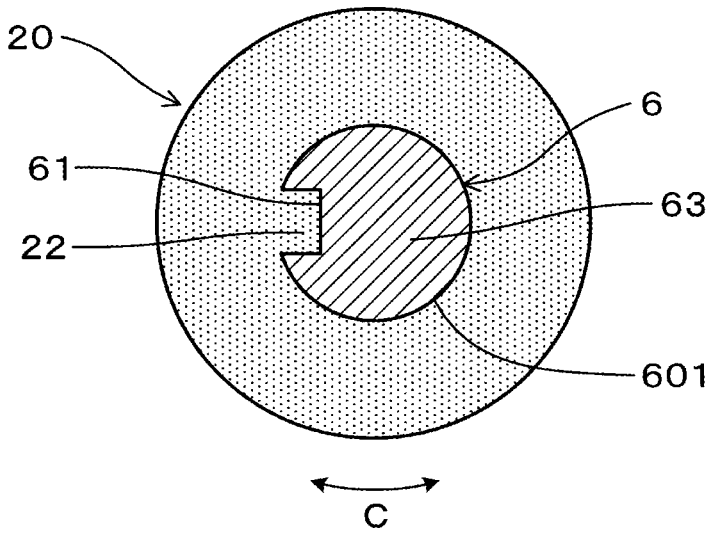
FIG. 7 is a cross-sectional view of the molding pin yet to be turned in the circumferential direction in the second removal step according to the embodiment.
Figure 8:
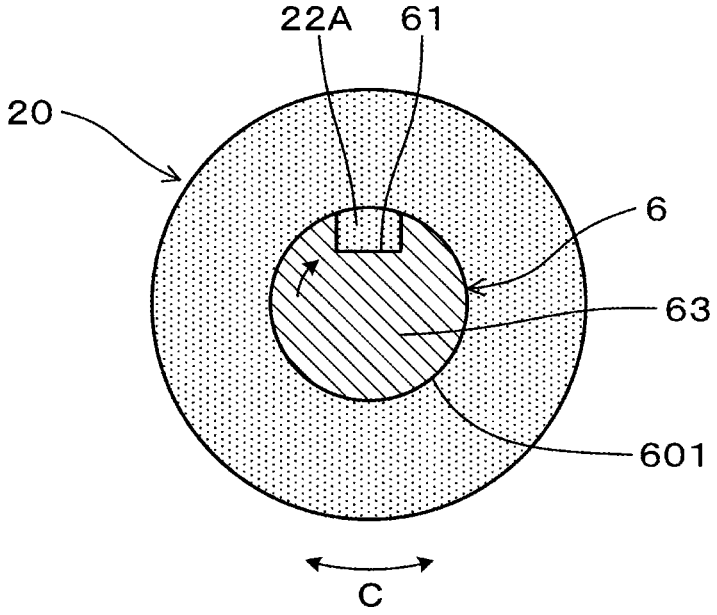
FIG. 8 is a cross-sectional view of the molding pin that has been turned in the circumferential direction in the second removal step according to the embodiment.
Figure 11:
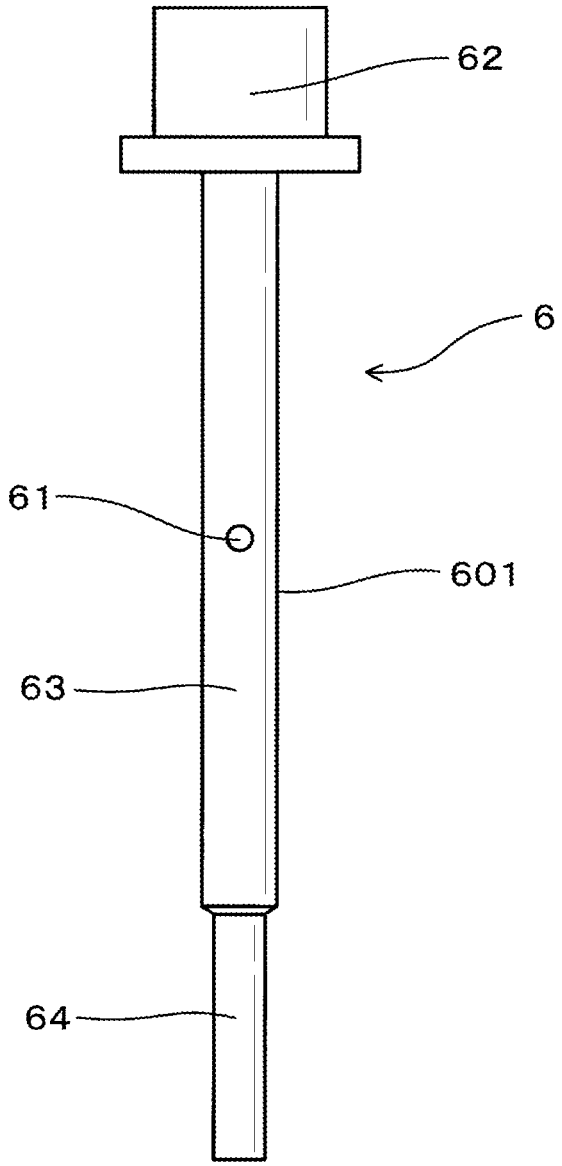
FIG. 11 is a side view of the molding pin according to the embodiment.

As illustrated in FIGS. 3, 7, and 11, the molding pin 6 has a recess 61 formed in its outer cylindrical surface 601 partially along a circumferential direction C. In first removal step S2, as illustrated in FIG. 5, a protrusion 22 from the compact 20 formed in the recess 61 of the molding pin 6 is locked in the recess 61 of the molding pin 6 to allow the compact 20 to be removed from the mold 5 with the molding pin 6. In second removal step S3, as illustrated in FIGS. 6 to 8, the molding pin 6 is turned or rotated in the circumferential direction C about the compact 20, causing the recess 61 to cut the protrusion 22 from the compact 20, and then the molding pin 6 is removed from the compact 20.

The spark plug 1 in the present embodiment will now be detailed.

Spark Plug 1

The spark plug 1 is used to generate a spark in a combustion chamber in an internal combustion engine to ignite a mixture of fuel and air. The spark plug 1 is coupled to an ignition coil and applies high voltage generated through the secondary coil of the ignition coil to the center electrode 41. The ground electrode 31 of the spark plug 1 is electrically connected to a cylinder head for the internal combustion engine and grounded.

As illustrated in FIG. 1, for the spark plug 1 according to the present embodiment, the direction parallel to the central axis of the central shaft 4 is referred to as a longitudinal direction L. In the longitudinal direction L, the direction toward the combustion chamber in the internal combustion engine is referred to as distal (L1), and the direction opposite to distal (L1) is referred to as proximal (L2).

Housing 3

As illustrated in FIG. 1, the housing 3 includes a male thread 32 formed in a distal (L1) part in the longitudinal direction L and screwed into the cylinder head, the ground electrode 31 provided on the distal (L1) end of the male thread 32, a hexagonal portion 33 formed on a proximal (L2) part in the longitudinal direction L and used for installation of the spark plug 1, and an insertion hole 34 for receiving the insulator 2. To form a spark gap K between the ground electrode 31 and the center electrode 41, the ground electrode 31 extends parallel to the longitudinal direction L and then bends to be orthogonal to the longitudinal direction L. The insertion hole 34 is stepped in a manner that conforms to the stepped outer cylindrical surface of the insulator 2.

Central Shaft 4

As illustrated in FIG. 1, the central shaft 4 is inserted through a hole 21 formed in the insulator 2. The central shaft 4 includes the center electrode 41 placed in a part of the hole 21 distal (L1) in the longitudinal direction L, an insertion shaft 42 placed in a part of the hole 21 proximal (L2) to the center electrode 41, and a connection terminal 43 coupled to the proximal (L2) end of the insertion shaft 42 and protruding in the proximal (L2) direction of the longitudinal direction L along the insulator 2 to connect to the high voltage terminal of the ignition coil. The insertion shaft 42 is narrower than the connection terminal 43, and the center electrode 41 is narrower than the insertion shaft 42. The hole 21 in the insulator 2 is stepped in a manner that conforms to the stepped outer cylindrical surface of the center electrode 41 and the insertion shaft 42.

Insulator 2

As illustrated in FIG. 1, the insulator 2 is a sintered body of the compact 20 formed of ceramic powder such as alumina and has a cylindrical shape with the hole 21. The hole 21 includes a small hole part 211 that is located in the part of the hole 21 distal (L1) in the longitudinal direction L and receives the inserted center electrode 41, and a large hole part 212 that is located in the part of the hole 21 proximal (L2) in the longitudinal direction L, is wider than the small hole part 211, and receives the inserted insertion shaft 42. The insulator 2 has an outer cylindrical surface stepped in a manner that conforms to the shape of the insertion hole 34 in the housing 3.

The mold 5 and the molding pin 6 in the present embodiment will now be detailed.

Mold 5

As illustrated in FIG. 3, the mold 5 used in molding step S1 is rubber with a closed-bottomed cylindrical shape, and elastically deforms and becomes narrower under oil pressure Y. The part of the insulator 2 distal (L1) in the longitudinal direction L is formed by the bottom part of the mold 5.

Molding Pin 6

As illustrated in FIG. 11, the molding pin 6 is metal and includes a head 62 placed outside the mold 5, a proximal shaft 63 narrower than the head 62, connected to the head 62, and placed inside the mold 5, and a distal shaft 64 narrower than the proximal shaft 63, connected to the proximal shaft 63, and placed inside the mold 5. The head 62 of the molding pin 6 is placed near an opening 52 in the mold 5. The proximal shaft 63 of the molding pin 6 forms the large hole part 212 of the hole 21 in the insulator 2, and the distal shaft 64 of the molding pin 6 forms the small hole part 211 of the hole 21 in the insulator 2.

As illustrated in FIGS. 3, 7, and 11, the recess 61 in the molding pin 6 is formed in the outer cylindrical surface 601 of the proximal shaft 63 partially along the circumferential direction C. The molding pin 6 may have a single recess 61 or a plurality of recesses 61. The recess 61 in the present embodiment is circularly depressed as a cylindrical shape. The recess 61 may have a variety of shapes other than a cylindrical shape. For example, the recess 61 may have a shape such as a prism, a truncated cone, a truncated pyramid, or a dome.

The recess 61 may have a diameter and a depth that allow locking of the protrusion 22 of the compact 20 formed in the recess 61. The diameter of the recess 61 may be, for example, 1 mm or more and 2.5 mm or less. The depth of the recess 61 may be, for example, 0.5 mm or more and 1.5 mm or less.

Figure 12:
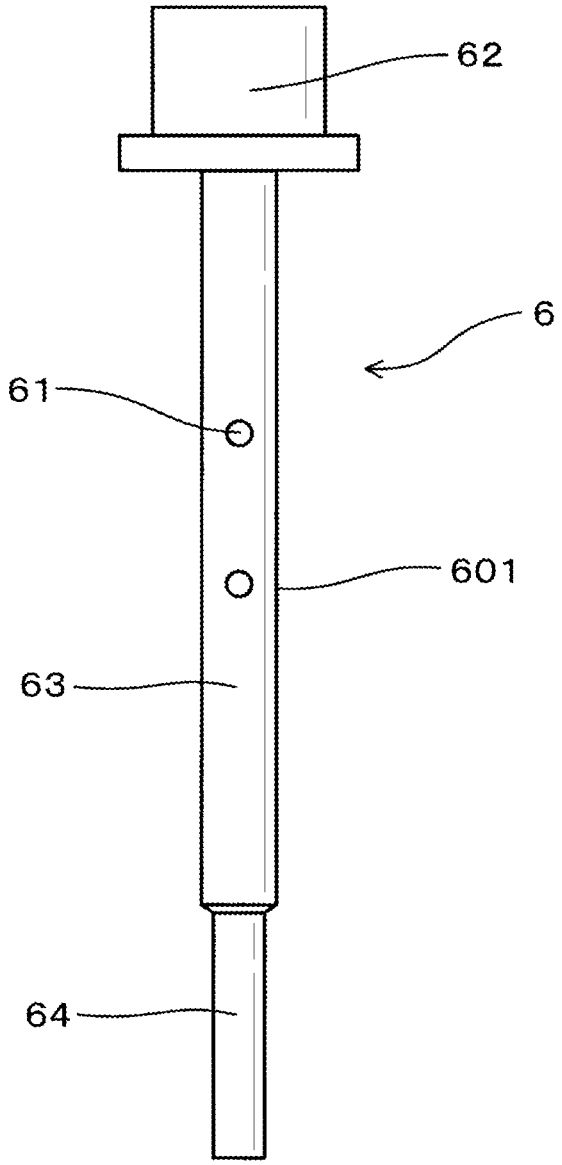
FIG. 12 is a side view of another molding pin according to an embodiment.
Figure 13:
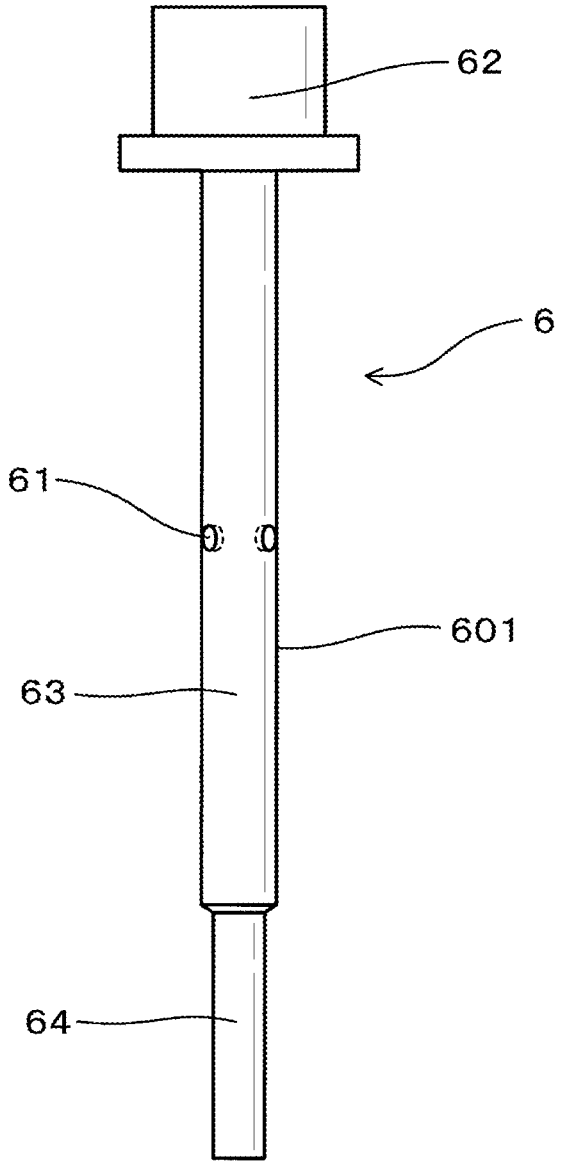
FIG. 13 is a side view of another molding pin according to an embodiment.

As illustrated in FIG. 12, a plurality of recesses 61 may be aligned in the longitudinal direction L of the molding pin 6. As illustrated in FIG. 13, a plurality of recesses 61 may be aligned in the circumferential direction C of the molding pin 6. The formation of a plurality of recesses 61 reduces the possibility that the compact 20 may suffer damage such as chips or cracks when the compact 20 is removed from the mold 5 with the molding pin 6.

Figure 14:
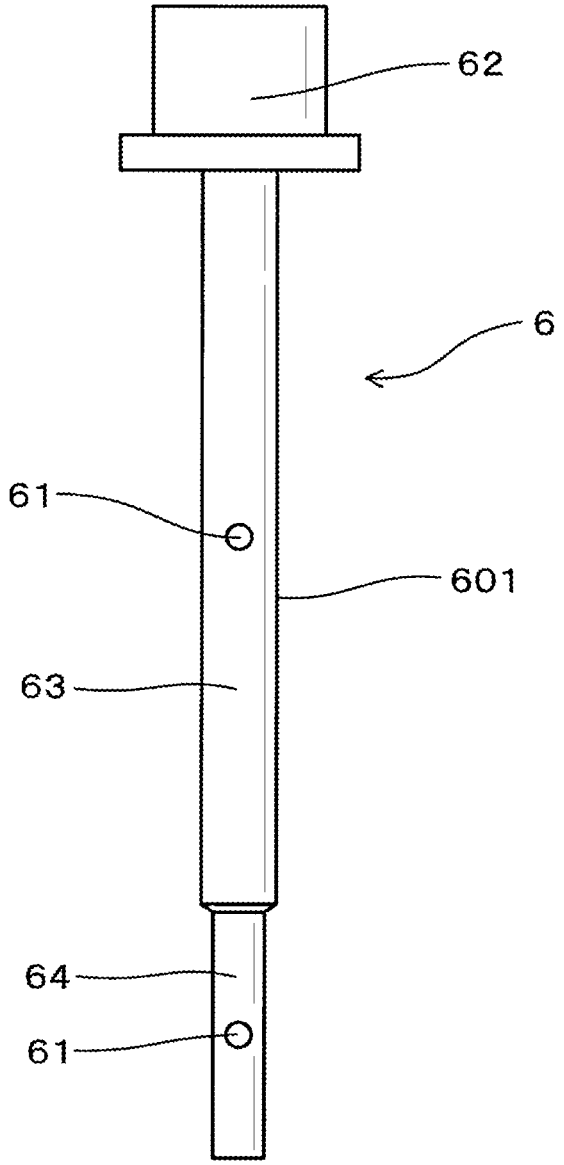
FIG. 14 is a side view of another molding pin according to an embodiment.

As illustrated in FIG. 14, the recess 61 may be formed in each of the outer cylindrical surface 601 of the proximal shaft 63 of the molding pin 6 and the outer cylindrical surface 601 of the distal shaft 64 of the molding pin 6. This formation further reduces the possibility that the compact 20 may suffer damage such as chips or cracks when the compact 20 is removed from the mold 5 with the molding pin 6.

Figure 15:
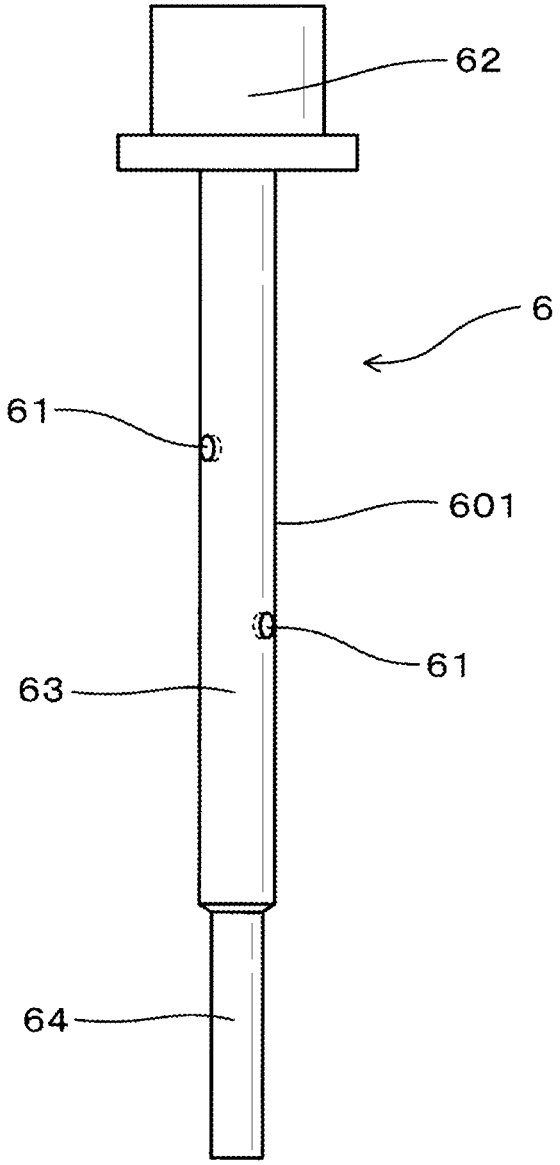
FIG. 15 is a side view of another molding pin according to an embodiment.

Alternatively, as illustrated in FIG. 15, a plurality of recesses 61 may be formed in the outer cylindrical surface 601 of the proximal shaft 63 or the outer cylindrical surface 601 of the distal shaft 64 at positions shifted from each other in at least one of the longitudinal direction L and the circumferential direction C of the molding pin 6. This formation also reduces the possibility that the compact 20 may suffer damage such as chips or cracks when the compact 20 is removed from the mold 5 with the molding pin 6.

The method of producing the insulator 2 for the spark plug 1 and the functional effects according to the present embodiment will now be detailed.

Insulator Production Method

In the present embodiment, as illustrated in FIG. 2, molding step S1, first removal step S2, second removal step S3, grinding step S4, and sintering step S5 are performed to produce the insulator 2. In molding step S1, the cavity 50 formed between the mold 5 and the molding pin 6 is filled with the ceramic powder 200 such as alumina, and the compact 20 is formed. More specifically, as illustrated in FIG. 3, the ceramic powder 200 is first filled into the rubber mold 5, and then the molding pin 6 is inserted into the ceramic powder 200 in the mold 5. The insertion of the molding pin 6 into the ceramic powder 200 in the mold 5 forms the cavity 50 filled with the ceramic powder 200, between the mold 5 and the molding pin 6.

Then, as illustrated in FIG. 4, the outer surface of the mold 5 is subjected to oil pressure Y controlled at a predetermined pressure to elastically deform and constrict the mold 5. As the mold 5 constricts, a molding surface 51 included in the mold 5 also constricts. The ceramic powder 200 is thus compressed into the compact 20 with the hole 21 formed in the position corresponding to the molding pin 6. Then, when oil pressure Y applied to the mold 5 is released, the mold 5 expands to its original state, and the molding surface 51 of the mold 5 separates from the outer cylindrical surface of the compact 20.

In molding step S1, the ceramic powder 200 is formed into the compact 20 in the cavity 50, with a cylindrical portion 23 and a bottom 24 that is distal (L1) in the longitudinal direction L. The cylindrical portion 23 is formed between the molding surface (inner cylindrical surface) 51 of the mold 5 and the outer cylindrical surface 601 of the molding pin 6. The bottom 24 is formed between the inner bottom surface of the molding surface 51 of the mold 5 and the distal end surface of the molding pin 6.

When the compact 20 is formed, the ceramic powder 200 filled in the recess 61 of the molding pin 6 is formed as the protrusion 22. Then, fitting between the recess 61 and the protrusion 22 integrates the molding pin 6 and the compact 20 with each other.

Then, as illustrated in FIG. 5, in first removal step S2, the compact 20, which has the cylindrical portion 23 and the bottom 24, is removed (extracted) together with the molding pin 6. In this step, the protrusion 22 of the compact 20 formed in the recess 61 of the molding pin 6 is locked in the recess 61, allowing the compact 20 to be removed with the molding pin 6. Gripping the head 62 of the molding pin 6 allows the removal of the compact 20 integrated with the molding pin 6. The compact 20 covers the proximal shaft 63 and the distal shaft 64 of the molding pin 6, and the protrusion 22 of the compact 20 is fitted in the recess 61 provided in the proximal shaft 63 of the molding pin 6.

In first removal step S2, the recess 61 of the molding pin 6 may be provided in the outer cylindrical surface 601 of the molding pin 6 partially along the circumferential direction C. Other than in the proximal shaft 63, the recess 61 may be provided in the distal shaft 64 or both the proximal shaft 63 and the distal shaft 64. The recess 61 formed in at least one of the proximal shaft 63 and the distal shaft 64 allows the compact 20 to be readily caught on the molding pin 6 when the compact 20 is removed from the mold 5. As a result, the compact 20 is removed from the mold 5 with the molding pin 6, with less damage such as chips or cracks.

For a conventional press pin with a helical ridge formed on the proximal end part of its proximal shaft 63, damage such as chips or cracks may occur in a part of the compact 20 distal (L1) in the longitudinal direction L in first removal step S2. In this press pin, the helical ridge is distant from a part of the compact 20 distal (L1) in the longitudinal direction L. Thus, when the compact 20 is extracted from the mold 5, the bottom 24 of the compact 20 and a part of the cylindrical portion 23 distal (L1) in the longitudinal direction L may not be sufficiently caught on the press pin, and the bottom 24 and the part of the cylindrical portion 23 distal (L1) in the longitudinal direction L may suffer damage such as chips or cracks. The molding pin 6 according to the present embodiment overcomes the problem of the damage such as chips or cracks.

Then, as illustrated in FIGS. 6 to 8, in second removal step S3, the molding pin 6 is removed (extracted) from the compact 20, which has the cylindrical portion 23 and the bottom 24. In this step, the molding pin 6 is turned in one direction of the circumferential direction C about the compact 20, causing the recess 61 of the molding pin 6 to cut the protrusion 22 of the compact 20. In other words, the protrusion 22 is shaved off by the recess 61. The molding pin 6 is turned in the circumferential direction C at an angle greater than the angle at which the recess 61 is formed in the circumferential direction C. FIG. 8 shows a portion 22A of the protrusion 22 cut and taken in the recess 61. In the compact 20, when the molding pin 6 is turned in the circumferential direction C, the inner cylindrical surface around the hole 21 including the section from which the protrusion 22 has been cut is evened off by the outer cylindrical surface 601 of the molding pin 6.

In second removal step S3, since the molding pin 6 is turned in the circumferential direction C to cut the protrusion 22 of the compact 20, the molding pin 6 is removed from the compact 20 with less damage such as chips or cracks. The recess 61 formed in the molding pin 6 allows the hole 21 in the compact 20 to remain in a preferable state.

The molding pin 6 can be removed from the hole 21 in the compact 20 after being turned around once or more in one direction of the circumferential direction C about the compact 20. In the compact 20, the turn can smoothen the inner cylindrical surface around the hole 21 including the section from which the protrusion 22 has been cut, ensuring the dimensional accuracy of the compact 20 such as the roundness. The molding pin 6 may also be removed from the hole 21 in the compact 20 after being rotated in opposite directions of the circumferential direction C.

For a conventional press pin with a helical ridge formed on the proximal end part of its proximal shaft 63, damage such as chips or cracks may occur in the site of the compact 20 facing the step between the proximal shaft 63 and the distal shaft 64 of the press pin in second removal step S3. In order to take the helical ridge off the helical part formed in the compact 20, this press pin is turned in the circumferential direction C about the compact 20. During this turning, the adhesion of the step of the compact 20 to the step of the press pin may cause a part of the step of the compact 20 to chip, and the resultant chip may adhere to the step of the press pin. The molding pin 6 according to the present embodiment overcomes the problem of the adhesion.

Figure 9:
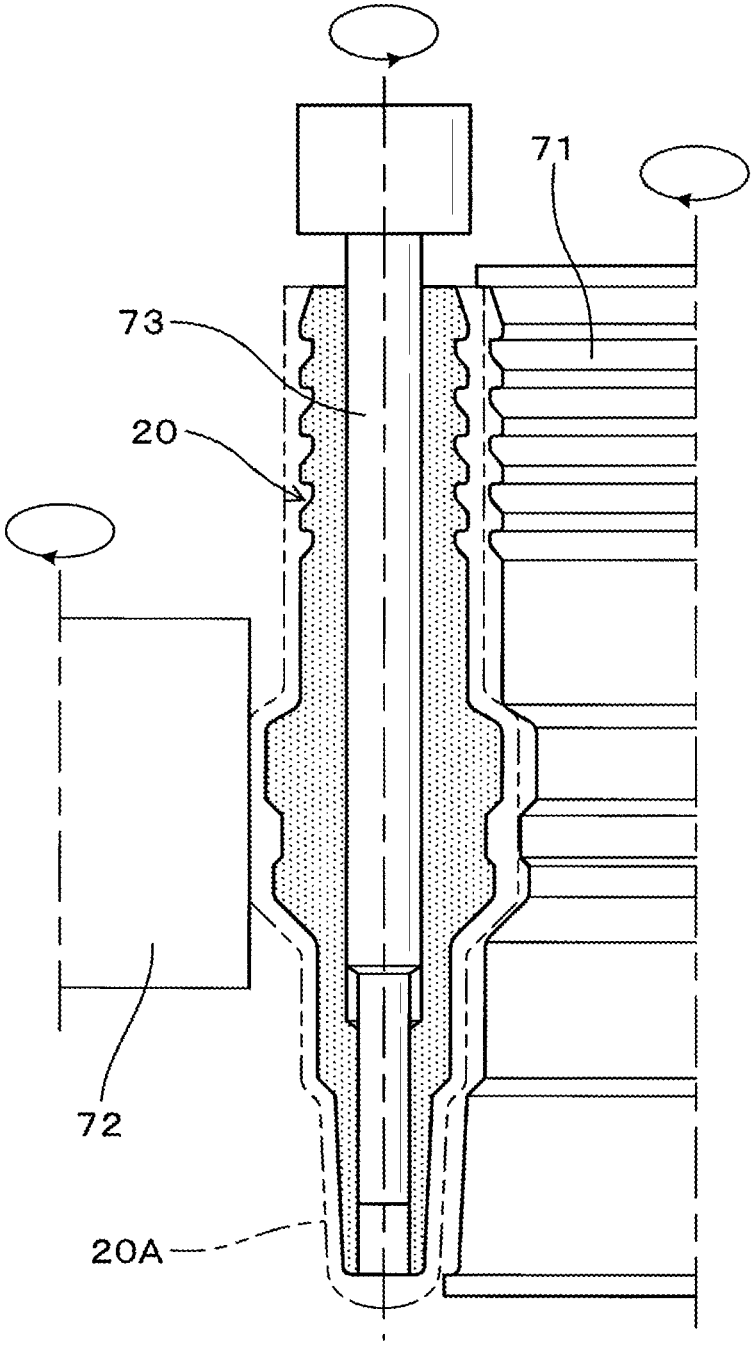
FIG. 9 is a cross-sectional view of the compact with its outer cylindrical surface being ground in a grinding step according to the embodiment.
Figure 10:
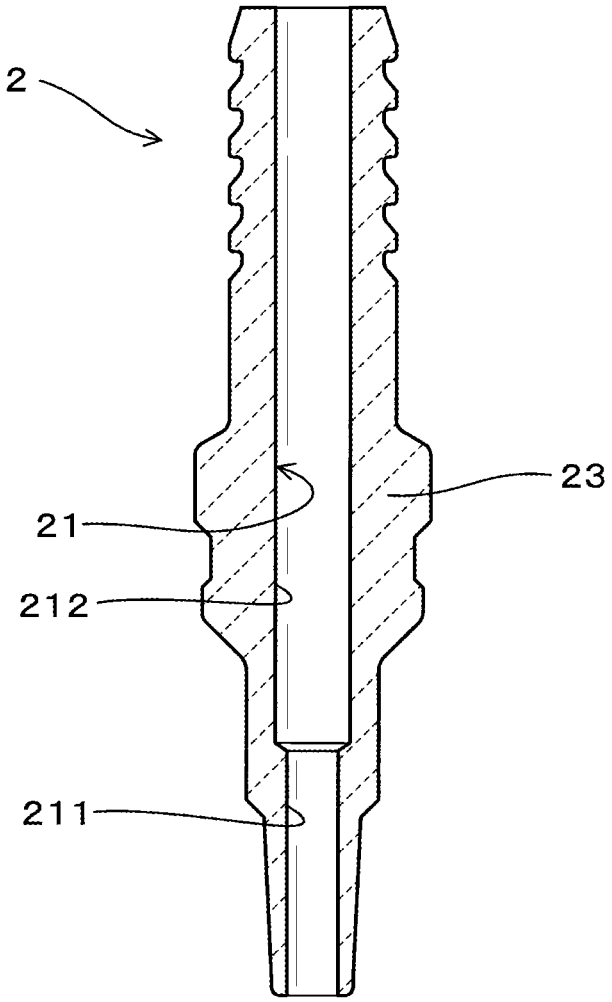
FIG. 10 is a cross-sectional view of the insulator according to the embodiment.

Then, as illustrated in FIG. 9, in grinding step S4, the outer cylindrical surface of the compact 20 is ground to form the final shape of the insulator 2. Before or after the outer cylindrical surface of the compact 20 is ground, the bottom 24 of the compact 20 is cut. In grinding step S4, a rotatable grindstone 71 is used to form the outer cylindrical surface of the insulator 2 in the outer cylindrical surface of the compact 20. The grindstone 71 is a rotatable and cylindrical or columnar component with a grinding surface formed in its outer surface. In grinding step S4, a tension roller 72 is used to turn the compact 20, and a support jig 73 is inserted in the hole 21 of the compact 20 to allow the compact 20 to spin freely. FIG. 9 shows the central axes of rotation of the grindstone 71, the tension roller 72, and the support jig 73 and the compact 20. FIG. 9 illustrates halves of the grindstone 71 and the tension roller 72 taken along the central axes.

The outer cylindrical surface of the tension roller 72 is brought into contact with the outer cylindrical surface of the compact 20. Then, the tension roller 72 turns the compact 20 about the support jig 73, while the grindstone 71 is being turned. The grinding surface of the grindstone 71 being turned is brought into contact with the outer cylindrical surface of the compact 20 that is turning. As a result, the grinding surface of the grindstone 71 grinds the outer cylindrical surface of the compact 20 into the shape conforming to the grinding surface of the grindstone 71, thus forming the compact 20 into the shape of the insulator 2. In FIG. 9, a compact 20A yet to be ground is indicated by a two-dot chain line, and the compact 20 that has been ground is indicated by a solid line.

Then, in sintering step S5, the compact 20 is heated to a sintering temperature and sintered to produce the insulator 2.

In this manner, the method of producing the insulator 2 for the spark plug 1 according to the present embodiment allows the insulator 2 to be produced using the molding pin 6 with the recess 61 formed in the outer cylindrical surface 601. The method of producing the insulator 2 also allows the insulator 2 to be produced with reduced damage such as chips or cracks.

The present disclosure is not limited to any one of the specific embodiments described above, but may be implemented in different embodiments without departing from the spirit and scope thereof. The disclosure encompasses various modifications and alterations that fall within the range of equivalence. Furthermore, combinations and forms of various components contemplated for the present disclosure are also within the technical idea of the disclosure.

What is claimed is:

1. A method of producing a cylindrical insulator for insulating, in a spark plug, a housing having a ground electrode and a central shaft having a center electrode from each other, the method comprising:

a molding step of forming ceramic powder filled in a cavity into a compact, the cavity defined by a mold configured to form an outer face of the insulator and a molding pin placed in the mold and configured to form an inner face of the insulator;

a first removal step of removing, from the mold, the compact with the molding pin placed therein; and a second removal step of removing the molding pin from the compact, wherein the molding pin has at least one recess formed in an outer cylindrical surface thereof partially along a circumferential direction of the outer cylindrical surface, in the first removal step, the compact has at least one protrusion formed in the at least one recess of the molding pin, and the at least one protrusion is locked in the at least one recess, thereby allowing the compact to be removed with the molding pin from the mold, and in the second removal step, the molding pin is turned or rotated in the circumferential direction about the compact, causing the at least one recess to cut the at least one protrusion from the compact, and thereafter the molding pin is removed from the compact.

2. The method according to claim 1, wherein the mold is rubber with a closed-bottomed cylindrical shape, in the molding step, the mold elastically deforms and becomes narrower under oil pressure to form a cylindrical portion of the compact between an inner cylindrical surface of the mold and an outer cylindrical surface of the molding pin and form a bottom of the compact between an inner bottom surface of the mold and a distal end surface of the molding pin, in the first removal step, the molding pin covered by the compact having the cylindrical portion and the bottom is removed from the mold, and in the second removal step, the molding pin is removed from the compact having the cylindrical portion and the bottom.

3. The method according to claim 1, wherein the molding pin includes a head placed outside the mold, a proximal shaft narrower than the head, connected to the head, and placed inside the mold, and a distal shaft narrower than the proximal shaft, connected to the proximal shaft, and placed inside the mold, and the at least one recess comprises at least one recess formed in an outer cylindrical surface of the proximal shaft and at least one recess formed in an outer cylindrical surface of the distal shaft.

4. The method according to claim 1, wherein the at least one recess comprises a plurality of recesses formed at positions shifted from each other in at least one of a longitudinal direction and a circumferential direction of the molding pin.

5. The method according to claim 1, wherein in the second removal step, the molding pin is turned around once or more in the circumferential direction about the compact.

* * * * *